United States Patent [19]

Lightfoot

[11] 3,983,670

[45] Oct. 5, 1976

[54] PARTITION SYSTEM

[75] Inventor: Herbert Douglas Lightfoot, Baie d'Urfe, Canada

[73] Assignee: Domtar Limited, Montreal, Canada

[22] Filed: Nov. 29, 1974

[21] Appl. No.: 528,083

[30] Foreign Application Priority Data

Dec. 6, 1973 Canada ..... 187616

[52] U.S. Cl. ..... 52/220; 52/241; 52/290

[51] Int. Cl.[2] ..... E04B 2/74

[58] Field of Search ..... 52/220, 221, 241, 290, 52/499

[56] References Cited

UNITED STATES PATENTS

| | | | |
|---|---|---|---|
| 2,808,136 | 10/1957 | Hammitt et al. | 52/220 X |
| 3,017,672 | 1/1962 | Vaughan | 52/241 |
| 3,562,985 | 2/1971 | Nicosia | 52/220 X |

*Primary Examiner*—J. Karl Bell
*Attorney, Agent, or Firm*—C. A. Rowley

[57] ABSTRACT

A partition system formed of a plurality of partition panel units held in erect position by an upper securing member and a lower securing member. The lower securing member is fixed to the floor and has a mounting surface in face-to-face relationship with the panel units. The system permits easy erecting of panel units from one side of the wall by slipping the top of each unit into the upper securing member, pivoting the unit into each face-to-face relationship with the mounting surface, adjusting the unit vertically and anchoring the unit in position. An open passage is formed beneath the panel units in the partition structure. This passage easily accommodates various services, such as wiring, and after such services are inserted, it is closed by means of a supporting plate which supports the side of the panel units remote from the mounting surface.

10 Claims, 5 Drawing Figures

PARTITION SYSTEM

FIELD OF THE INVENTION

The present invention relates to a partition system. More specifically the present invention relates to easily erected partition systems incorporating partition panel units that form both faces of the partition.

DESCRIPTION OF THE PRIOR ART

Many different partition structures are presently used in the industry. Probably the most prevalent in the housing industry incorporates wooden or metal studs with panels fixed to opposite sides thereof and with the joints between adjacent panels taped and filled to define the wall surface. In office buildings or the like, pre-finished panels are erected on opposite sides of metal framing members to form decorative wall faces. There are also structures incorporating "partition panel units." The term partition panel units is used herein to define panels that provide facing surfaces on opposite sides of the partition or wall.

The present invention is primarily concerned with the latter type of construction and provides a non-progressive partition system that is competitive with the stud and panel system used conventionally in housing and with the panel systems used in office buildings or the like.

It is an object of the present invention to provide a partition structure that is easily erected and requires a minimum number of different parts. It is a further object to provide a partition system wherein services such as electric wiring and the like may be easily accommodated within the wall structure.

SUMMARY OF THE INVENTION

Broadly, the present invention relates to a partition structure including an upper panel securing member and a lower panel securing member, said lower panel securing member having a securing section fixed to the floor and a mounting surface spaced above the securing section, a partition panel unit, said lower securing member permitting unobstructed movement of a partition panel unit from the side of said lower securing member remote from said mounting surface, into position in face-to-face relationship with said mounting surface, said partition panel unit being positioned at its upper end by said upper securing member and at its lower end by connecting means connecting said panel unit adjacent its bottom edge to said mounting surface, the bottom end of said partition panel unit being spaced from said securing section to provide a longitudinally extending passage between the bottom of said partition panel unit and said securing section.

BRIEF DESCRIPTION OF THE DRAWINGS

Further features, objectives and advantages will be evident from the following detailed description of a preferred embodiment of the present invention taken in conjunction with the accompanying drawings in which.

DESCRIPTION OF THE PREFERRED EMBODIMENTS

Figure 1:
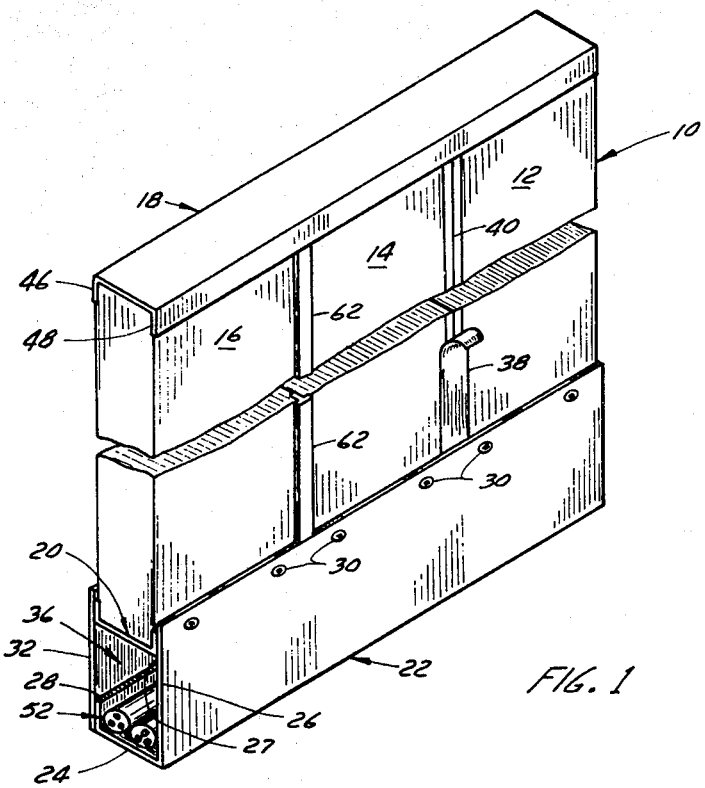
FIG. 1 is an isometric view illustrating a part of a wall section incorporating the present invention.

Referring to FIG. 1, a partition structure 10 is formed of a plurality of partition panel units indicated at 12, 14, 16, etc. held in position at their top edges by an upper securing member 18. This panel securing member 18 is substantially channel shaped and is secured to the ceiling in any suitable manner.

Each of the partition panel units 12, 14 or 16 has a bottom shoe 20 that embraces the bottom edge of the panel and is secured thereto preferably by friction. These shoes 20 preferably do not extend the full length of the units thereby facilitating the incorporaton of electrical wiring into the wall or partition being constructed. The shoes 20 generally are made of sheet metal and positioning the wire that extends into the partition panel unit beside rather than passing it through the shoe 20 eliminates problems associated with cutting of the shoe.

Lower ends of the panels 12, 14 and 16 are held by a lower panel securing member 22 which preferably is L-shaped and has a securing section 24 formed by a bottom leg and a mounting section 26 having a mounting surface 27. The mounting section 26 is formed by a leg projecting upwardly from one side of the securing section 24. A short lip 28 projects upwardly from the side edge of the securing section 24 remote from the mounting section 26. The lower member 22 and the shoe 20 are preferably fabricated from sheet metal whereby self-drilling and tapping metal screws 30 may be projected through the section 26 into the shoes 20, thereby to secure the bottom of panel units 12, 14 and 16 to the sections 26 and to hold the panel units in erected position. It is important that the mounting surface 27 be parallel to the plane of the panel unit to permit adjustment of the unit to accommodate variations in the floor to ceiling height. It is also important that the side of member 22 remote from the mounting section 26 be unobstructed to permit the panel units 12, 14 or 16, etc., to be moved into contact with the surface 27 from the said opposite side and to be shifted axially for adjustment into their final positions.

The other main component of the present invention is a structural plate 32 which bridges the opening 34 into the longitudinally extending passage 36 defined by the bottom of the shoe membes 20, i.e. of the panel units 12, 14 and 16 and the top of section 24. The plate 32 is secured to the lip 28 and to the bottom shoe 20 preferably by self-drilling self-tapping metal screws so that the plate which preferably is made of metal provides structural support for the units 12, 14 and 16 thereby to impart the necessary rigidity to the partition. Preferably a separate plate 32 will be provided for each panel unit. These discrete plates 32 preferably are substantially the same length as the shoes 20 thereby to provide gaps between adjacent plates 32 to permit access to the passage 36.

Adjacent panel units may be interconnected in any suitable manner (in some cases there need be no connection at all). The unit to unit connection used will depend on the type of panel unit used; for example, whether the panel unit is pre-finished or not. It will also depend on the structural strength of the panel unit as in some cases it may be necessary to provide a structural joint between adjacent partition panel units to transmit forces there between and thereby further increase the strength of the wall or partition being constructed. One type of joint particularly suitable for non-prefinished panel units is the conventional taped and filled joint used in dry wall construction.

If desired, the top or upper panel securing member 18 may also be hidden by the conventional taping techniques while the bottom securing member 22 together with cover plate 32 are hidden by conventional baseboards or the like.

Preferably, the top securing member 18 is a substantially channel shaped member having flanges 46 and 48 that tightly receive the top edge of the panels 12, 14 and 16. In fact, the member 18 and shoe 20 may be essentially identical in cross-section.

To erect a partition incorporating the present invention, the upper and lower securing members 18 and 22 are secured respectively to the ceiling and floor generally in substantially vertical alignment. The units 12, 14, 16, etc. are erected from the side of partition remote from the mounting section 26 of the bottom member 22.

Figure 2:
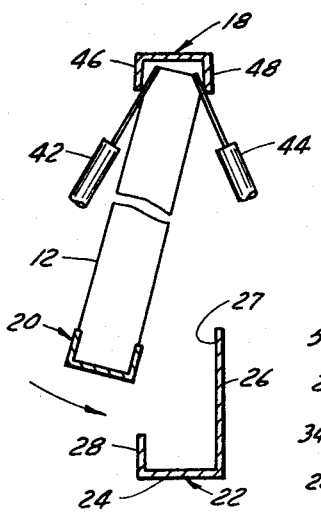
FIGS. 2, 3, 4 and 5 are schematic section views through the partition illustrating the sequence for erecting a panel.
Figure 3:
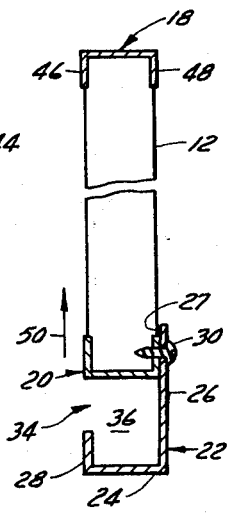

Each of the panel units 12, 14 and 16, etc., is inserted into the top securing member 18, moved into engagement with the mounting surface 26 and lifted as indicated by the arrow 50 into its final position. When each panel unit is in its final position, suitable self-drilling, self-tapping metal screws are driven through the section 26 into one of the flanges of the channel shaped shoe 20 to secure the panel unit in erected position. In a preferred arrangement, the upper securing member 18 snugly receives the top end of the panel unit and with this arrangement suitable "panel guides" schematically illustrated at 42 and 44 in FIG. 2 are used to guide the panel unit into the upper member 18. These guides spring apart the flanges 46 and 48 of the upper member 18 as the top end of the panel unit enters the member 18. The guides are removed after the panel unit has been inserted.

Figure 4:
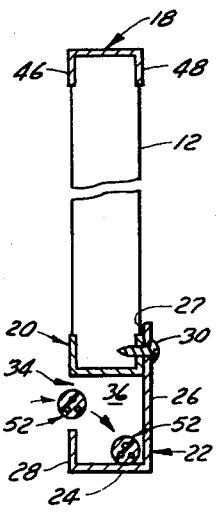
Figure 5:
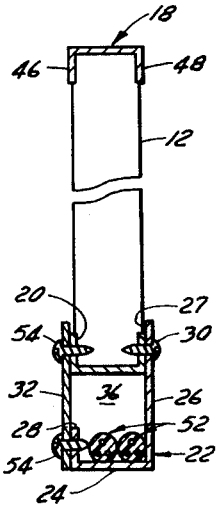

The panels, 12, 14 and 16, etc., may be erected in sequence using the above described technique thereby to form the wall or partition. Thereafter, electrical wiring as indicated schematically at 52 may be inserted view the opening 34 into the passage 36 (see FIG. 4). After the wiring has been inserted the structural plate or plates 32 are secured in position to aid in supporting the partition. If desired, each of the plates 32 may be secured in position as each panel unit is erected and the wiring or the like threaded through the passage 36 by using the gap between adjacent plates for access.

As above indicated, the panel unit to panel unit joint may be of any suitable construction, for example, opposite sides of the joint such as the butt joint 40 shown in FIG. 1 may be joined by the conventional method used in drywall construction, i.e. incorporating suitable tape 38 and joint fillers on opposite sides of the partition. Alternatively for example, batten strips as illustrated at 62 in FIG. 1 may be positioned on opposite sides of the partition and secured together in conventional manner.

As above indicated, the term partition panel unit or panel unit is used herein to signify a unit having two facing sides, i.e. opposite sides of the unit form the faces on opposite sides of the partition. The structure of the partition panel unit may be solid core, hollow core or any other type of construction to provide a unit that will form opposite faces of the partition or wall.

Modifications may be made without departing from the spirit of the invention as defined in the appended claims.

I claim:

1. A partition structure comprising an upper panel securing member and a substantially L-shaped lower panel securing member, one arm of said L-shaped lower panel securing member forming a securing section adapted to be fixed to the floor and the other arm of said L-shaped lower securing member forming a mounting section having a mounting surface spaced above the securing section, a partition panel unit, said lower securing member permitting unobstructed movement of said partition panel unit from the side of said lower securing member remote from said mounting surface into position in face to face relationship with said mounting surface, said partition panel unit being positioned at its upper end by said upper securing member, screws penetrating said panel unit adjacent its bottom edge and securing said panel unit in face to face relationship with said mounting surface and holding the bottom edge of said partition panel unit spaced from said securing section to provide a longitudinally extending open passage between the bottom of said partition panel unit and said securing section.

2. A partition structure as defined in claim 1 further comprising a shoe at the bottom of said panel units and wherein said screws extend through at least a portion of said shoe.

3. A partition structure as defined in claim 1 further comprising a substantially channel shaped shoe on the bottom of said panel unit, said shoe having a pair of spaced flanges embracing opposite faces of the panel adjacent the bottom of said panel and wherein said screws extend through said mounting section and one of said flanges on said shoe.

4. A partition structure as defined in claim 3 further comprising structural plate means extending from adjacent said securing section to the bottom of said unit, said plate means obstructing the opening into said passage.

5. A partition structure as defined in claim 2 further comprising structural plate means extending from adjacent said securing section to the bottom of said unit, said plate means obstructing the opening into said passage.

6. A partition structure as defined in claim 4 wherein said plate means is secured to said panel unit by screws extending through the other of said flanges on said shoe.

7. A partition structure as defined in claim 5 wherein said plate means is secured to said panel unit by screws extending through a further portion of said shoe.

8. A partition structure as defined in claim 1 wherein said upper securing member is U-shaped and snugly receives the top end of said panel unit.

9. A partition structure as defined in claim 3 wherein said upper securing member is U-shaped and snugly receives the top end of said panel unit.

10. A partition structure as defined in claim 4 wherein said upper securing member is U-shaped and snugly receives the top end of said panel unit.

* * * * *